United States Patent [19]

Lembke

[11] Patent Number: 4,978,031

[45] Date of Patent: Dec. 18, 1990

[54] DISPENSER SYSTEM FOR RAZOR BLADE UNITS

[75] Inventor: Max Lembke, Middlesex, United Kingdom

[73] Assignee: Wilkinson Sword Gesellschaft mit beschrankter/Haftung, Solingen, Fed. Rep. of Germany

[21] Appl. No.: 376,663

[22] Filed: Jul. 7, 1989

[30] Foreign Application Priority Data

Jul. 7, 1988 [DE] Fed. Rep. of Germany ..... 3822947

[51] Int. Cl.[5] ..... B65D 83/10

[52] U.S. Cl. ..... 221/102; 221/303; 221/312 C; 206/356; 206/360; 30/40

[58] Field of Search ..... 30/40, 41; 206/356, 206/359, 360; 221/97, 102, 312 R, 312 C, 303, 307

[56] References Cited

U.S. PATENT DOCUMENTS 3,785,051 1/1974 Dawidowicz et al. ..... 221/102
3,880,321 4/1975 Braginetz ..... 221/102
3,941,244 3/1976 Braginetz ..... 221/102
4,140,244 2/1979 Clabby ..... 206/356

*Primary Examiner*—H. Grant Skaggs
*Attorney, Agent, or Firm*—Robert W. Becker & Associates

[57] ABSTRACT

A dispenser system for razor blade units, including a dispenser housing in which the razor blade units are successively and displaceably disposed. Via a handle that is provided with a latching mechanism that cooperates with the razor blade units, the razor blade units can be removed from the dispenser housing one at a time. To simplify securement of the handle to a razor blade unit that is to be removed, the dispenser housing has a guide mechanism along which the end of the handle is guided and which brings the latching mechanism of the handle into a disengagement position. After reaching the removal position, the handle automatically engages the razor blade unit, so that this unit can be removed from the dispenser housing.

18 Claims, 7 Drawing Sheets

Fig.4
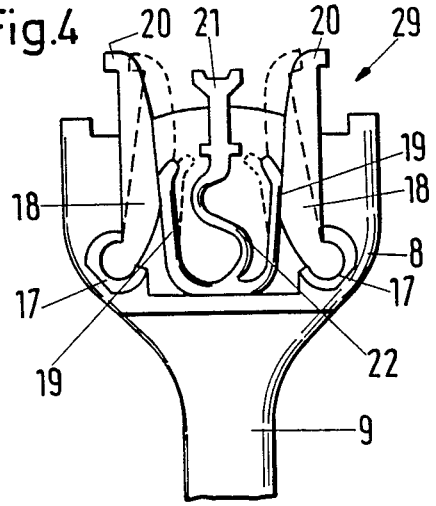
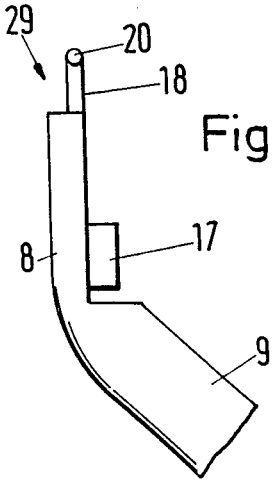
Fig.5
Fig.6
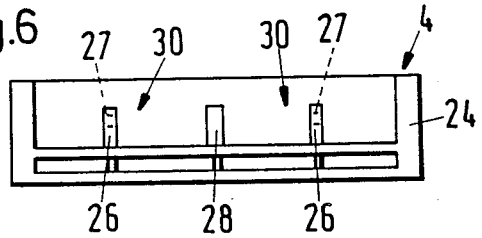
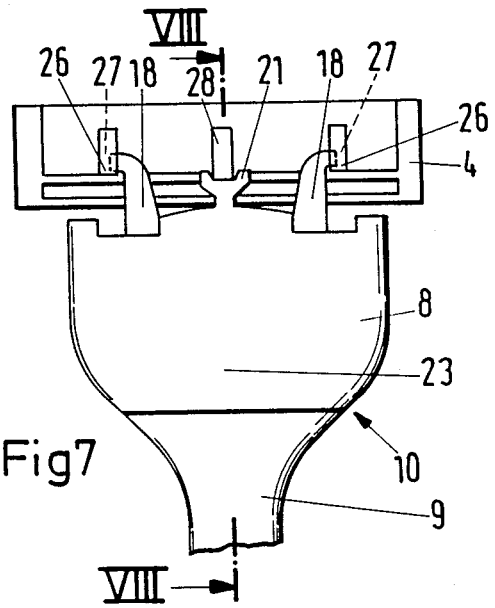
Fig7
Fig.8
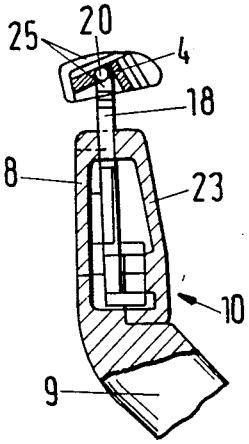

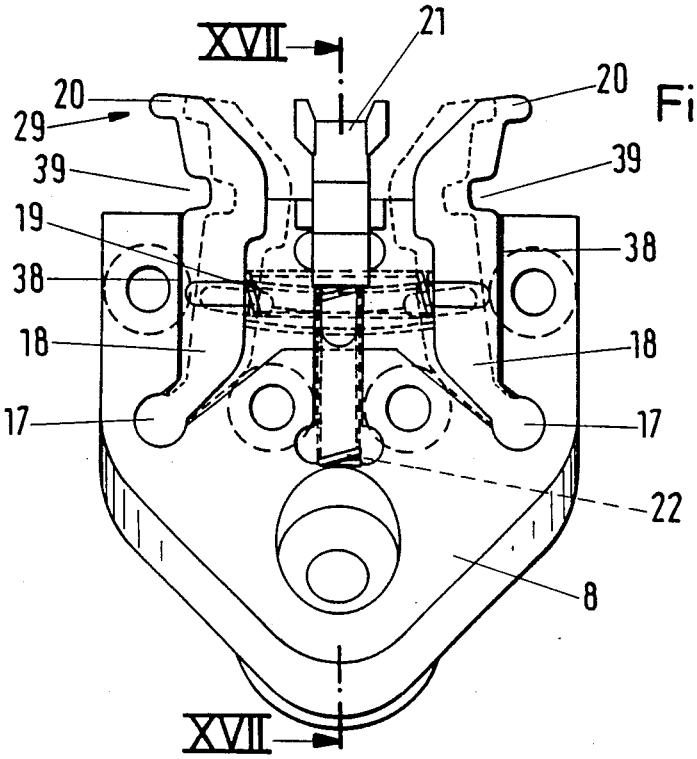
Fig.16
Fig.17
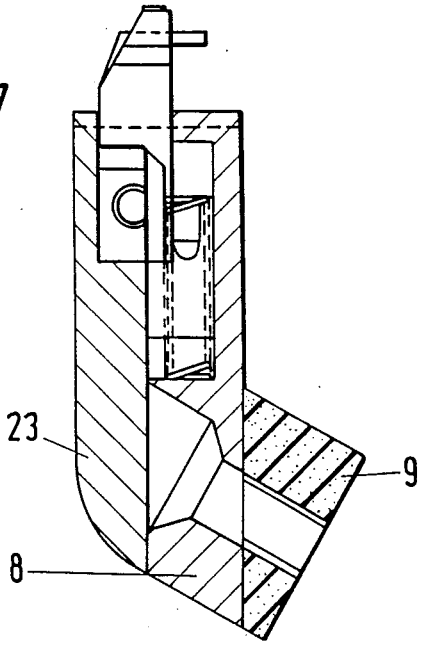

DISPENSER SYSTEM FOR RAZOR BLADE UNITS

BACKGROUND OF THE INVENTION

The present invention relates to a dispenser system for razor blade units, several of which are successively arranged in a dispenser housing or case in such a way that they rest parallel against one another, with the razor blade units being adapted to be removed from, and possibly reinserted in, the dispenser housing via a handle to form a razor. The end of the handle, as well as the razor blade units, have latching mechanisms that cooperate with one another.

Dispenser systems for razor blade units are known, with the phrase razor blade units referring to razor heads where the single or double razor blades are fixedly embedded in a plastic body, and the razor blade units can be secured to an end of a handle, whereby for this purpose the end of the handle, as well as the razor blade units, have cooperating latching mechanisms.

With the heretofore known dispenser system, several razor blade units are disposed in a dispenser housing in appropriate compartments. In order to remove the individual razor blade units from, and possibly reinsert them in, the dispenser housing, the handle of the razor has an appropriate control knob for bringing the latching mechanism of the handle into a disengagement position. In this position, the handle can be placed against a razor blade unit that is to be removed and can be latched therewith, so that the razor blade unit can be removed from the appropriate compartment of the dispenser housing via the handle that is now secured to the razor blade unit. A razor formed in this manner can then be used for shaving. The reinsertion of a used razor blade unit is carried out in the reverse manner.

The drawback of this known dispenser system for razor blade units is that the securement of the end of the handle to the razor blade unit that is to be removed is not always easy and requires some skill, since the latching mechanism of the end of the handle must be brought precisely into the latching position with the cooperating latching mechanism of the razor blade unit. Especially for people whose hands tremble somewhat or who cannot see well, this procedure can lead to considerable difficulties.

It is therefore an object of the present invention to provide a dispenser system, for razor blade units, with which the handle of the razor can be secured in a simple manner to a razor blade unit that is to be removed from the dispenser housing.

BRIEF DESCRIPTION OF THE DRAWINGS

This object, and other objects and advantages of the present invention, will appear more clearly from the following specification in conjunction with the accompanying schematic drawings, in which:

FIG. 4 is a view of the end of a handle, with the cover of the handle end being omitted to more clearly show the interior;

FIG. 5 is a side view of the end of the handle of FIG. 4;

FIG. 6 is a rear view of a razor blade unit;

FIG. 7 shows the razor blade unit of FIG. 6 engaged with a handle to form a razor;

FIG. 8 is a cross-sectional view taken along the line VIII—VIII in FIG. 7;

FIG. 16 is a view of the end of a handle in a second embodiment, with the cover of the handle end being omitted to more clearly show the interior of the handle end;

FIG. 17 is a cross-sectional view taken along the line XVII-XVII in FIG. 16;

SUMMARY OF THE INVENTION

Figure 1:
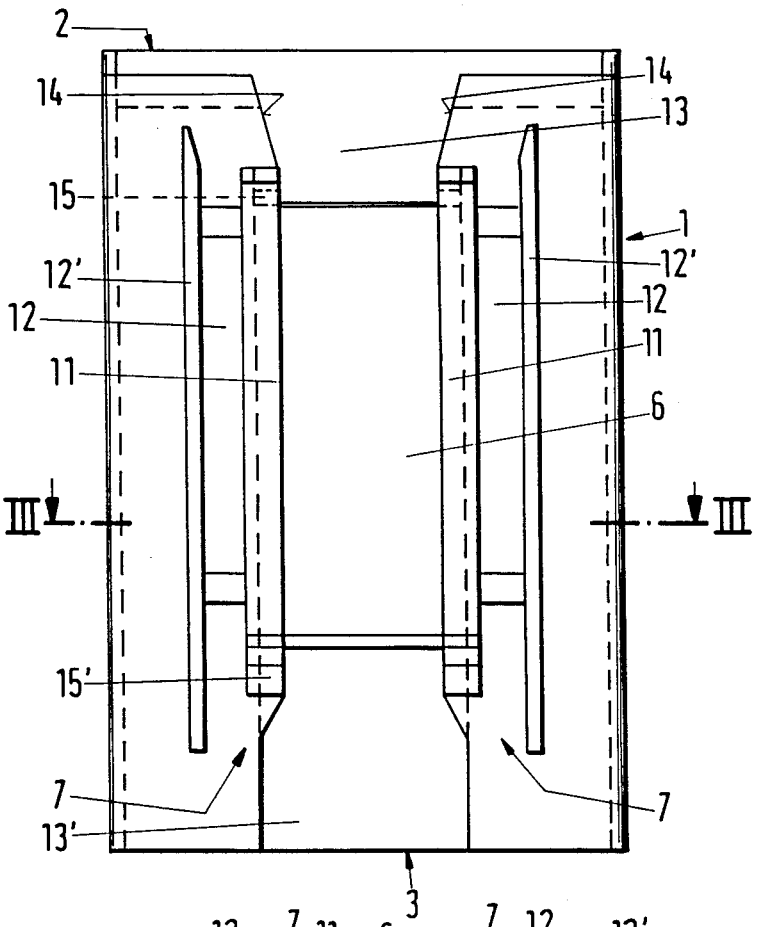
FIG. 1 is a plan view of one exemplary embodiment of a dispenser housing of the inventive system.
Figure 2:
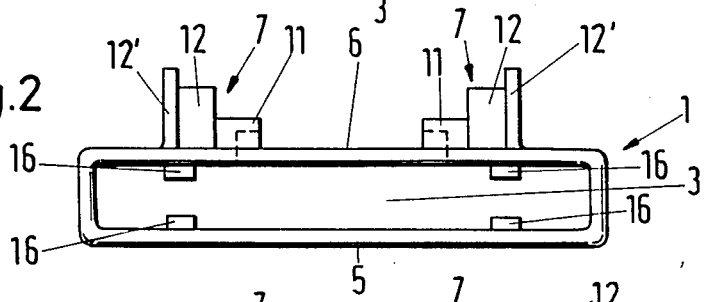
FIG. 2 is an end view of the dispenser housing of FIG. 1.
Figure 3:
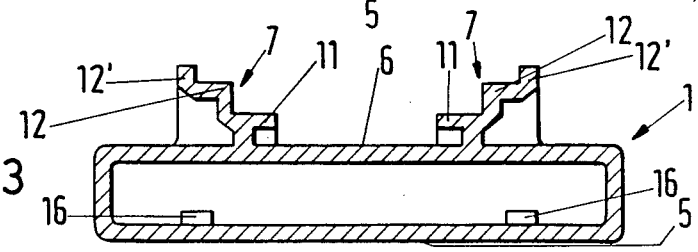
FIG. 3 is a cross-sectional view taken along the line III—III in FIG. 1 through the dispenser housing.

The dispenser system of the present invention is characterized primarily in that: the razor blade units are disposed in the dispenser housing in such a way that they can be shifted in their entirety both perpendicular to their longitudinal dimension as well as in a plane formed by them, with that moved-up razor blade unit that at any given time is in a forwardmost position being located, for removal thereof by the handle, in a removal position that is common for all razor blade units and is provided at a removal opening that is disposed at an end of the dispenser housing; and the dispenser housing has, for the end of the handle, a guide mechanism that ends in the vicinity of the removal opening and that, as the latching mechanism of the end of the handle is guided along, brings the last-mentioned latching mechanism into a disengaged position, whereby, as the latching mechanism of the handle end reaches the removal position, the guide mechanism releases this latching mechanism so that the latter changes into a latching position, which forms a normal position, thereby latching with the razor blade unit that is to be removed.

A dispenser system constructed pursuant to the teaching of the present invention has the advantage that the razor blade units can be removed from the dispenser housing via the handle in an extremely easy manner. For this purpose, it is merely necessary to place the end of the handle in the guide mechanism of the dispenser housing and to guide the handle end to the removal position, where the latching mechanism of the handle automatically latches with the latching mechanism of the razor blade unit that is to be removed, thereby forming a razor that is ready for use. It is then merely necessary to remove the razor blade unit, which is disposed on the front end of the handle, from the dispenser housing. Since the razor blade units are disposed in the dispenser housing in such a way that they can be moved up, the subsequent razor blade unit moves up into the removal position at the removal opening, so that this razor blade unit can be removed as the next unit.

The guide mechanism is preferably disposed on the upper side of the dispenser housing parallel to the direction of movement of the razor blade units. This represents a straightforward possibility for placing the guide mechanism on the dispenser housing.

So that after removal of the forwardmost razor blade unit from the dispenser housing, the remaining razor blade units can move up in a simple manner, a compression-type spring is preferably disposed between the last razor blade unit and that end wall of the dispenser housing that is disposed opposite the removal opening.

In the event that used razor blade units are not to be reinserted into the dispenser housing, it is proposed pursuant to one preferred embodiment of the present invention that the handle is provided with a manually operable device for converting the latching mechanism into the disengagement position In this way, the handle can very easily be "relieved" of a used razor blade unit.

However, in order to be able to reinsert used razor blade units into the dispenser housing, it is proposed pursuant to another preferred embodiment of the present invention that at that end opposite from the removal opening the dispenser housing be provided with an inlet or introduction opening for the reinsertion of used razor blade units. In this connection, after insertion of the used razor blade unit and upon guidance of the handle from the inlet opening to the removal opening via the guide mechanism, which begins in the vicinity of the inlet opening, this guide mechanism brings the latching mechanism of the handle into the disengaged position, thereby releasing the connection to the reinserted razor blade unit. In this way, it is very easy to rapidly replace a used razor blade unit, without great effort, with an unused razor blade unit, with the used razor blade unit first being introduced into the inlet opening of the dispenser housing. The guide mechanism, which starts here, disengages the handle from the reinserted razor blade unit as the handle is moved in the direction toward the removal opening. When the handle has arrived at the removal opening, it takes up the unused razor blade unit that is ready for removal. Thus, the "disposal" of a used razor blade unit, and the receipt of an unused razor blade unit, is so to speak effected in a single operation, i.e. in a continuous operating sequence. The reinsertion of a used razor blade unit in addition has the effect that thereby the razor blade units disposed in the dispenser housing are moved up in their entirety, so that the forwardmost razor blade unit is brought to the removal position.

One preferred specific embodiment of the guide and latching mechanism of the inventive dispenser system proposes that the latching mechanism of the handle comprise two arms that are pivotable in opposite directions against the force of a spring, and that at their front ends have catch means that are directed opposite to the respective pivot direction, with the razor blade units having receiving holes that cooperate with the catch means, and with the guide mechanism, on the upper side of the dispenser housing, being provided with two C-shaped guide channels that extend at a distance from and parallel to one another for receiving the catch means, whereby the distance between the two guide channels is such that the arms are pivoted into the disengagement position, and whereby the guide channels, in the region of the openings to the razor blade units that are to be removed or reinserted, are guided at an angle into the engagement and disengagement positions. This represents a technically straightforward possibility for releasing or establishing the connection between the handle end and the respective razor blade unit. In this connection, the catch means, which are oriented parallel to the cutting edge of the razor blade, serve as a pivot axis for a pivot head razor, which can adapt very precisely to the contours of a person's face. The arms are preferably pivotable inwardly toward one another, and the catch means are directed outwardly away from one another. In this way, a relatively great distance can be obtained between the catch means, thereby assuring a good stability between the handle and the razor blade unit that is connected thereto.

Pursuant to a further feature of the present invention, it is proposed that in the region of the openings, the dispenser housing be provided with guides for the latching mechanism of the handle, with these guides extending at an angle relative to the direction of movement of the razor blade units. Especially in the region of the inlet opening, these guides assure that upon introduction of razor blade units that are to be reinserted, the latching mechanism disposed on the handle is gradually moved into the disengagement position. Adjoining these guides are then the guide channels of the preferred guide mechanism construction.

In a further specific embodiment of the inventive dispenser system, it is proposed that the dispenser housing be embodied as an essentially flat, hollow parallelepiped, with the opposing open ends thereof defining an inlet opening for the reinsertion of used razor blade units as well as the removal opening for unused razor blade units; the upper side of the dispenser housing is provided with an opening that is continuous from the inlet opening to the removal opening and that at its ends, in the vicinity of the inlet and removal openings, has an expanded trapezoidal width, whereby those edges of the dispenser housing that delimit the opening and extend parallel to one another in the central portion define rails. In addition, the latching mechanism of the handle comprises two arms that can be pivoted inwardly toward one another against the force of a spring, with the forward ends of these arms being provided with catch means that are directed outwardly away from one another and cooperate with receiving holes in the razor blade units: the outer edge of each arm is provided with a recessed guide portion that cooperates with the corresponding rail of the dispenser housing. Also in this way, it is very easy to rapidly replace, without great effort, a used razor blade unit with an unused razor blade unit, with the used razor blade unit first being introduced into the inlet opening of the dispenser housing via the handle. The disengagement mechanism for the pivotable arms of the handle is thereby formed by the edge-like rails of the dispenser housing, as well as by the recessed guide portions in the arms of the latching mechanism, with the recessed guide portions meshing with the rails that define the opening. As a consequence of the trapezoidal tapering of this opening in the vicinity of the inlet opening, the arms are pivoted inwardly, sc that the catch means become disengaged from the receiving holes in the razor blade unit. During this disengagement process, the razor blade units that are already disposed in the dispenser housing are at the same time conveyed one position further, so that the used razor blade unit that was just introduced assumes the last position. The handle is subsequently moved further in the direction toward the removal opening and takes up the unused razor blade unit that is already ready for removal. Thus, the "disposal"πof the used razor blade unit, as well as the receipt of the unused razor blade unit, can be carried out in a single operation, i.e. in a continuous operating sequence. In addition, the reinsertion of the used razor blade unit has the effect that thereby the razor blade units disposed in the dispenser housing are moved up in their entirety, so that the forwardmost razor blade unit is brought into the removal position. The thus-embodied dispenser system is characterized by a structurally straightforward construction as well as by being very operable and having a high operational reliability. The razor blade units are received and dispensed very reliably.

In one preferred development of this structural embodiment, relative to the insertion and removal planes of the razor blade units into and out of the inlet and removal openings respectively, in the central portion of the opening the upper side of the dispenser housing, with the rails, is offset upwardly, and/or the receiving channel for the razor blade units within the dispenser housing is offset downwardly, with the offsets being such that the catch means of the arms of the latching mechanism of the handle, after release of the used razor blade unit, are movable from this rear position into the forward removal position over the razor blade units that are disposed therebetween. Preferably, both the rails and the receiving channel are offset upwardly or downwardly respectively, so that already after a short distance, the catch means of the arms have achieved such a height above the razor blade units that they can be moved past these units.

Pursuant to a further specific embodiment of the present invention, the razor blade units are guided laterally within the dispenser housing by guide rails that are disposed in the vicinity of the side walls of the dispenser housing. In a technically straightforward manner, these guide rails prescribe the path along which the razor blade units move. In particular, it is thereby possible in a technically straightforward manner to lower the receiving channel for the razor blade units in the central region.

In one preferred specific embodiment of the dispenser housing, this housing is composed of two halves that are divided along the longitudinal central axis. This has the advantage that the dispenser housing can be manufactured in a very simple manner by an injection molding process.

In addition, the dispenser housing may be provided on the outside with transversely extending reinforcement ribs. These ribs prevent the upper, free legs from deforming inwardly during molding, which would make the dispenser housing unusable.

In order to be able to fix the razor blade units within the dispenser housing, it is proposed pursuant to a further feature of the present invention to dispose spring-like cams in the dispenser housing in the vicinity of the inlet and removal openings; these cams hold the razor blade units within the dispenser housing, yet allow the razor blade units that are to be removed or reinserted to pass by after overcoming the holding force exerted thereby.

A further specific embodiment of the present invention proposes that the razor blade units each have a central rib, and that the end of the handle is provided with a projecting pronged member that is spring loaded in the direction of the handle end, cooperates with the central rib, and receives the same. With a pivot head razor, this construction has the advantage that the razor blade unit always assumes a defined starting position into which it automatically springs back after having been deflected.

In order to improve the guidance of the end of the handle on the dispenser housing, the guide mechanism is preferably provided with guide strips that cooperate with the handle end.

Finally, it is proposed pursuant to the present invention that a compression-type spring be disposed between the last unused razor blade unit and the first used razor blade unit. This assures that the razor blade units are securely held within the dispenser housing, without rattling noises resulting, for example during movement of the dispenser housing. Furthermore, the compression-type spring assures that a razor blade unit that is to be removed is located exactly in the removal position. In this connection, the compression-type spring is preferably embodied in such a way that it cannot pass the spring-like cams. In addition to the advantage of correcting for gaps that exist between the razor blade units, this has above all the advantage that when only used razor blade units are disposed in the dispenser housing, no such units can be removed, since the compression-type spring, which is not located at the forwardmost position, acts so to speak as a barrier and cannot be removed, thereby indicating to the user that he has no unused razor blade units available any more.

Further specific features of the present invention will be described in detail subsequently.

DESCRIPTION OF PREFERRED EMBODIMENTS

Referring now to the drawings in detail, FIGS. 1 to 10 illustrate a first embodiment of the inventive dispenser system, and FIGS. 11 to 20 illustrate a second exemplary embodiment.

In conformity with the first exemplary embodiment of the inventive dispenser system, a dispenser housing 1 of a molded plastic part is embodied as a flat parallelepiped. One end of the dispenser housing 1 (at the top in FIG. 1) is provided with an inlet or introduction opening 2, and the opposite end (at the bottom in FIG. 1) is provided with a removal opening 3. These openings 2, 3 are provided for razor blade units 4; however, these razor blade units are not illustrated in FIGS. 1 to 3, so that in these figures the dispenser housing 1 is shown in an empty state.

Although the underside 5 of the dispenser housing 1 is completely flat and closed off, the upper side 6 has a guide mechanism 7 for the head or end 8 of a handle 9 of a razor 10, which will be shown and described only subsequently. The guide mechanism 7 primarily comprises two guide channels 11 that extend parallel to one another and that, as can best be seen in FIG. 3, have a C-shaped cross-sectional configuration and are disposed at a particular distance from one another. The guide channels 11 extend over nearly the entire length of the dispenser housing 1, and at the ends are angled off toward the upper side 6, as can be seen, for example, in the cross-sectional view of FIG. 9. Formed on the outer side of each guide channel 11 is a respective guide strip 12, which is inclined at the ends. Formed on the outer side of each of these guide strips 12 is a further guide strip 12' that is disposed somewhat higher than its guide strip 12.

In the vicinity of the inlet opening 2, the upper side 6 of the dispenser housing 1 is provided with a trapezoidal cutout or notch 13. The inclined edges of the notch 13 serve as guides 14. These guides 14 end in the vicinity of the guide channels 11, with the upper side 6 of the dispenser housing 1 being provided with a pass-through slot 15 at this location.

A corresponding cutout or notch 13' is provided in the region of the removal opening 3. Here also the upper side 6 of the dispenser housing 1 is provided with a pass-through slot 15'.

In the region of the openings 2 and 3, the interior of the dispenser housing 1 is provided with dogs or cams 16 for holding the razor blade units 4 in place within the dispenser housing 1. This can be seen particularly clearly in FIG. 9.

FIGS. 4 and 5 show in particular the end 8 of the handle 9 for the razor 10. Two arms 18 are mounted in support means 17 in the end 8 in such a way that they can be pivoted inwardly. In FIG. 4, both the normal as well as the inwardly pivoted position of the arms 18 are illustrated. Disposed between the arms 18 is a U-shaped spring 19 that presses the arms 18 outwardly so that they rest against the end 8 of the handle 9. Each of the free ends of the arms 18 is provided with a respective outwardly directed, pin-like catch means 20.

FIG. 4 furthermore shows a pronged member 21 that is mounted in the end 8 in such a way as to be displaceable in a longitudinal direction, with a spring 22 pressing the pronged member 21 into the forward normal position. In this connection, the spring 22 is integrally formed with the U-shaped spring 19. The end 8 of the handle 9 is closed off by a cover 23, which in the view of FIG. 4 is left off in order to be able to clearly recognize the parts that are disposed in the interior of the end 8.

FIG. 6 shows a conventional razor blade unit 4, i.e. one in which two razor blades 25 (FIG. 8) are embedded in a plastic body 24. However, of interest is only the back side of the razor blade unit 4, as shown in FIG. 6. As can be seen, two ribs 26 are formed on the plastic body 24, with each rib 26 being provided with a receiving hole 27 that cooperates with one of the pin-like catch means 20. Also formed on the plastic body 24 is a central rib 28 that cooperates with the pronged member 21 of the handle 9 in such a way that the pronged member 21 receives the central rib 28 in the mounted position.

This mounted state is illustrated in FIGS. 7 and 8 for the formation of a complete razor 10. As can be seen in particular in FIG. 7, after the arms 18 of the handle 9 have been temporarily pivoted inwardly, the catch means 20 thereof are received by the receiving holes 27 in the razor blade unit 4 to form an axis of rotation for a so-called pivot head razor. In this connection, the pronged member 21 presses the central rib 28, and hence the entire razor blade unit 4, away from the end 8 of the handle 9, so that the razor blade unit 4 assumes a mid-position to which it resiliently returns after being moved out of position.

As can be seen from the foregoing description, the arms 18 with the catch means 20 form a latching mechanism 29 that is associated with the end 8 of the handle 9, and the receiving holes 27 provided in the ribs 26 form a latching mechanism 30 that is associated with the razor blade unit 4 and cooperates with the latching mechanism 29.

Figure 9:
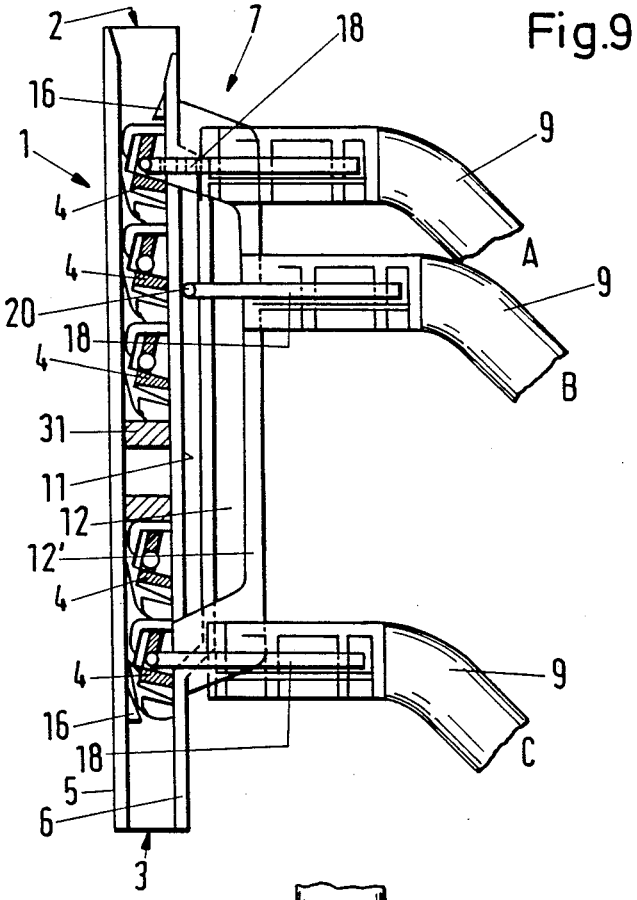
FIG. 9 is a longitudinal cross-sectional view through the dispenser housing of FIG. 1, showing razor blade units in the housing and different positions of a handle for reinserting a used razor blade unit and for removing an unused razor blade unit.
Figure 10:
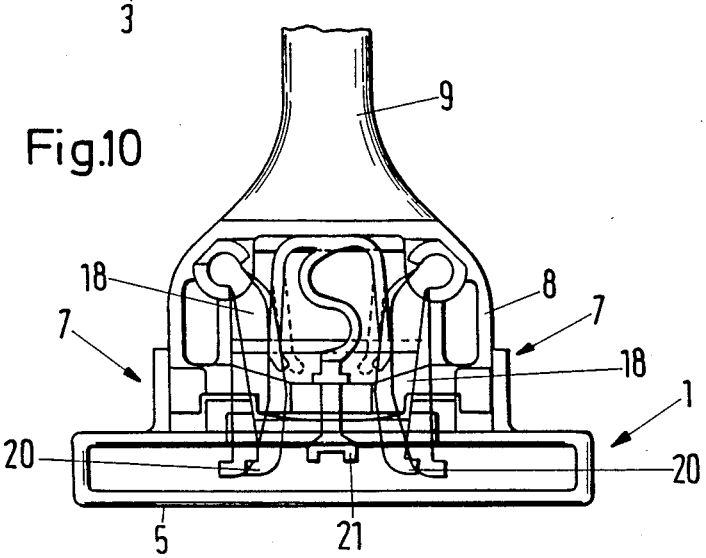
FIG. 10 is an end view of the end of a handle as it rests on the dispenser housing and is guided therealong.
Figure 11:
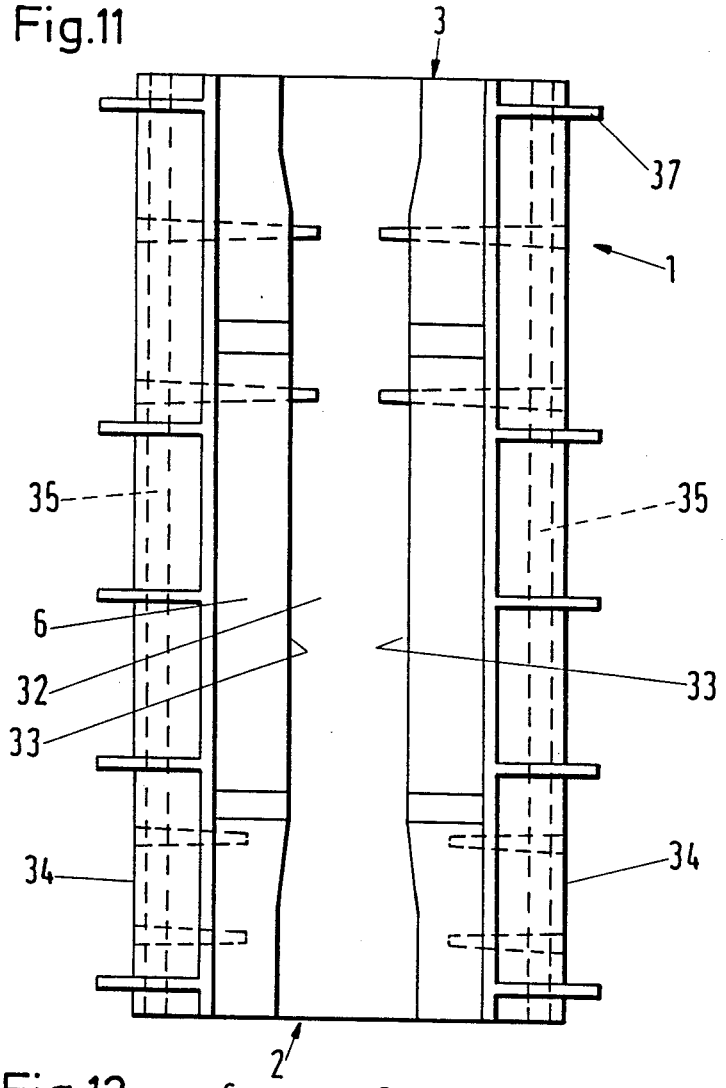
FIG. 11 is a plan view of a second exemplary embodiment of a dispenser housing of the inventive system.
Figure 12:
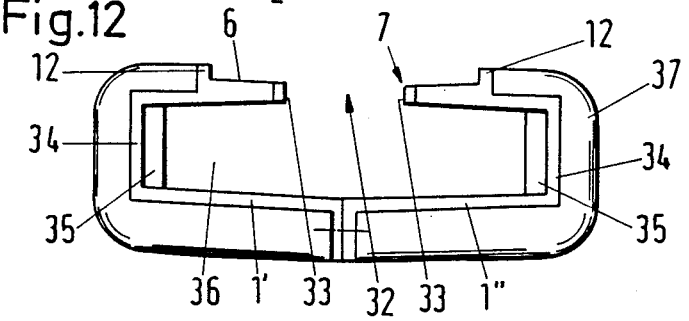
FIG. 12 is an end view of the dispenser housing of FIG. 11.

FIG. 9 shows a dispenser housing 1 that is filled with a total of five razor blade units 4. The razor blade units 4 are held by the cams 16. Disposed between the two lowermost razor blade units 4 and the three upper razor blade units 4 is a compression-type spring 31 that presses the razor blade units 4 outwardly for abutment against the cams 16. The two lower razor blade units 4 are unused, whereas the three upper razor blade units 4 have already been used and put back in.

The operation of this first exemplary embodiment of the inventive dispenser system is as follows:

A used razor blade unit 4 is to be replaced by an unused razor blade unit. For this purpose, the used razor blade unit 4, which is still connected to the handle 9, is introduced by this handle into the inlet or introduction opening 2 of the dispenser housing 1 (from above in FIG. 9). In so doing, the arms 18 come to rest against the conically tapered guides 14 in the notch 13 in such a way that the arms 18 are pivoted inwardly. This can also be seen, for example, in FIG. 10, although without the corresponding razor blade unit 4. At the narrowest location of the guides 14 where the smallest gap exists, the catch means 20 of the arms 18 come out of engagement with the receiving holes 27 in the razor blade unit 4, thereby releasing this unit. The used razor blade unit 4 has reached it release position when it has pressed the razor blade unit 4 disposed therebelow by one position further, so that the most forwardly disposed and still unused razor blade unit 4 assumes the removal position at the opening 3.

After disengagement or release of the used razor blade unit 4, the handle 9 assumes the position A shown in FIG. 9. Subsequently, the catch means 20 of the arms 18 of the handle 9 are guided upwardly through the pass-through slot 15 to the upper side 6 of the dispenser housing 1 and into the guide channels 11, and are moved along these guide channels to the removal opening 3. This position of movement is indicated by the position B. Due to the distance between the guide channels 11, the arms 18 remain in the inwardly pivoted position. During the movement of the catch means in the guide channels 11, the guide strips 12 and 12', in cooperation with the end 8 of the handle 9, assume guiding characteristics.

As soon as the end 8 of the handle 9 reaches the removal opening 3, the catch means 20 of the arms 18 again enter the dispenser housing 1 via the pass-through slot 15'. In this position, the pin-like catch means 20, which are still pivoted inwardly, are aligned with the receiving holes 27 of the razor blade unit 4; this is indicated by the position C in FIG. 9. If the end 8 is now moved further in the direction of the removal opening 3, the pronged member 21 takes the central rib 28, and hence the razor blade unit 4, along with it. Due to the conically expanding notch 13', the arms 18 gradually move outwardly under the force of the spring 19, and come to rest in the receiving holes 27 of the razor blade unit 4. In this position, the razor blade unit 4 is securely connected to the end 8 of the handle 9, so that are appropriate razor 10 is formed. The razor blade unit 4 can then be completely withdrawn from the dispenser housing 1.

The second exemplary embodiment of the inventive dispenser system similarly has a plastic dispenser housing 1. The basic shape of this housing is similarly a flat hollow parallelepiped, and is composed of two housing halves 1', 1'' along the longitudinal central axis, as can be seen in particular in FIG. 12. The ends of the elongated hollow parallelepiped are each open and define the inlet or introduction opening 2 as well as the removal opening 3 for the razor blade units 4. On the upper side, the dispenser housing 1 is provided with an opening 32 that extends in the longitudinal direction in a continuous manner from the inlet opening 2 to the removal opening 3. The opening 32 is defined by the upper edges 33 of the two housing halves 1' and 1'', with these edges 33 forming rails, the purpose of which will be explained subsequently. As can be seen in the plan view of FIG. 11, the two edges 33, starting from the inlet opening 2, first extend parallel for a short distance. The edges 33 subsequently angle off towards the central longitudinal plane, reducing the width of the opening 32. Thereafter, the edges 33 again extend parallel, angling off outwardly in the region of the removal opening 3; subsequently, the edges 33 again extend parallel at the original width of the opening 32.

Figure 13:
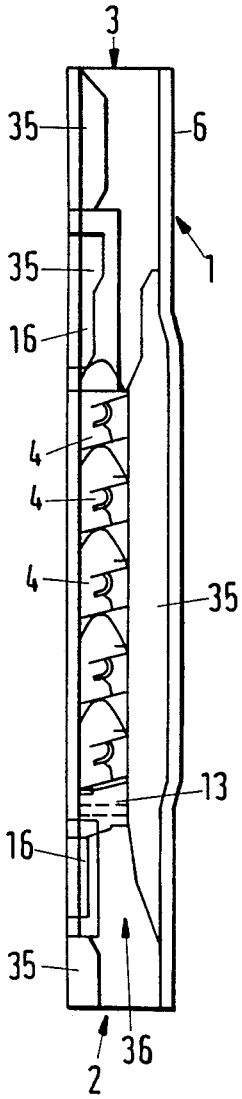
FIG. 13 is a side view of the dispenser housing of FIG. 11.
Figure 14:
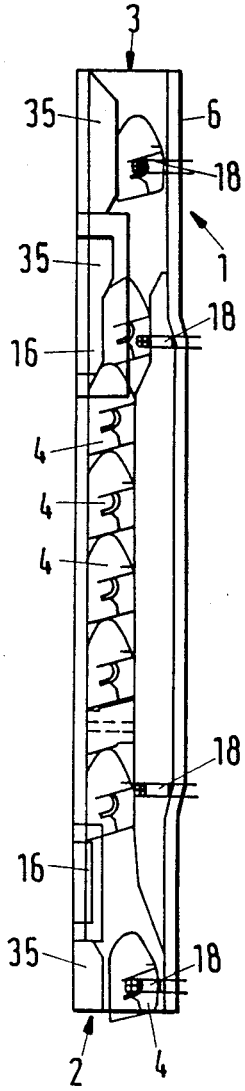
FIG. 14 is a side view of the dispenser housing of FIG. 11, showing various positions of a handle for reinserting a used razor blade unit and for removing an unused razor blade unit.
Figure 15:
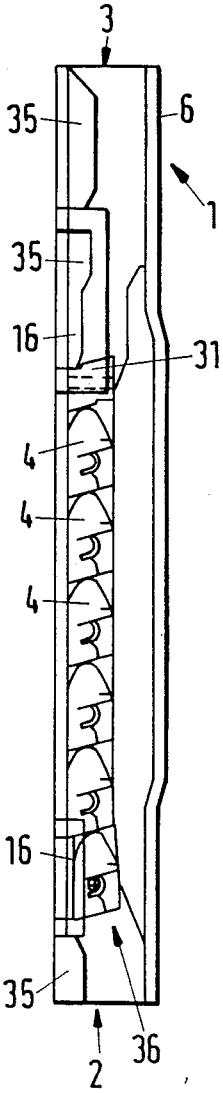
FIG. 15 is a side view of the dispenser housing of FIG. 11, with the housing being completely filled with used razor blade units.

As can furthermore be seen in particular in the side views of FIGS. 13 to 15, in the central region, the upper side 6 of the dispenser housing 1, together with the edges 33, are offset upwardly, and in particular in that portion of the opening 32 that has the narrowest width.

Formed on the side walls 34 of the dispenser housing are guide rails 35 that define the receiving channel for the razor blade units 4 along the dispenser housing 1, and via which the two lateral ends of the razor blade units 4 are guided. As can be seen, starting from the inlet opening 2, the receiving channel 36 is angled off toward the bottom, returning to its original height at the back end in the region of the removal opening 3.

Finally, disposed within the dispenser housing 1 in the region of the two openings 2 and 3 ar spring-like dogs or cams 16 which the razor blade units 4 can pass, yet which fix the razor blade units in position therebetween in such a way that the razor blade units cannot fall out.

The upper side 6 of the dispenser housing 1 is additionally provided with longitudinally extending guide strips 12. The dispenser housing 1 is also provided with transversely extending reinforcement ribs 37.

As illustrated in FIGS. 16 and 17, associated with this dispenser housing 1 is an end 8 of a razor, with the handle 9 only being indicated. Two arms 18 are mounted in the end 8 in support means 17. Against the force of a spring 19, which is in the form of a helical spring, the arms 18 can be pivoted inwardly, with the normal position being illustrated by solid lines and the inwardly pivoted position being shown by dashed lines. At their front end, each arm 18 is provided with a respective catch means 20, with the two catch means 20 being directed outwardly and cooperating with corresponding receiving holes 27 in the plastic body 24 of the razor blade unit 4 to define a pivot axis. The important thing with this embodiment is that the outer edges 38 of the two arms 18 are each provided with a respective recessed guide portion 39 that cooperates with an edge 33 of the dispenser housing 1.

The end 8 is additionally provided with a pronged member 21 that is pressed to the front via a spring 22, which is similarly embodied as a helical spring. The functioning mechanism is thereby the same as with the first embodiment of the end 8.

Figure 19:
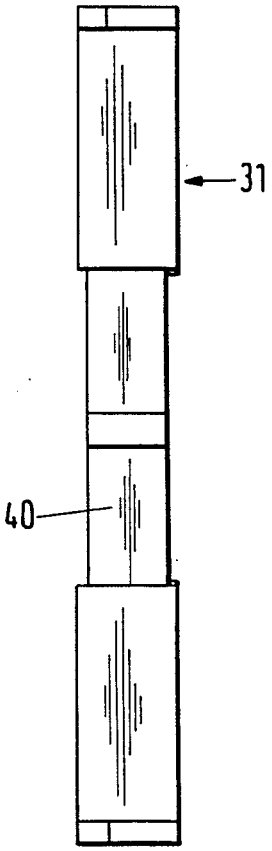
FIG. 19 is a front view of the spring of FIG. 18.
Figure 18:
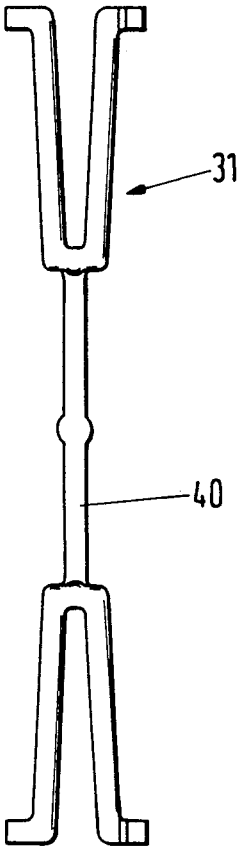
FIG. 18 is a plan view of a compression-type spring that is disposed within the dispenser housing between the unused and used razor blade units.
Figure 20:
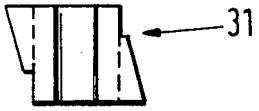
FIG. 20 is an end view of the spring of FIG. 18.

As can be seen in particular in FIG. 14, provided between the used and the unused razor blade units 4 is a compression-type spring 31. Enlarged views thereof are shown in FIGS. 18 to 20. Each end of the spring 31 is provided with spring portions in the form of fork springs that are connected to one another by a center element 40. As can be seen in particular in the end view of FIG. 20, the side profile of the compression-type spring 31 cooperates with the cams 16 disposed within the dispenser housing 1, and in particular in a manner that will be described subsequently.

The operation of the dispenser system of this second inventive embodiment is described as follows:

A used razor blade unit 4 is to be replaced by an unused razor blade unit. For this purpose, the used razor blade unit 4, which is still connected to the handle 9, is introduced via the handle 9 into the inlet or introduction opening 2 of the dispenser housing 1 (from below in FIG. 14). In so doing, the catch means 20 of the arms 18 of the end 8 of the razor engage in the cooperating receiving holes 27 in the plastic body 24 of the razor blade unit 4.

After the razor blade unit 4 is shifted further in the direction of the removal opening 3, the edges 33 of the dispenser housing 1 initially receive the recessed guide portions 39 in the arms 18 of the end 8. In so doing, the arms 18 are still in their normal position and hence in engagement with the razor blade unit 4.

As the razor blade unit 4 is shifted further, it encounters the inwardly angled edges 33, so that the arms 18 are gradually pivoted inwardly and hence become disengaged from the receiving holes 27. At the same time, as a consequence of the arrangement of the guide rails 35, the receiving channel 36 is angled toward the bottom, finally passing the spring-like cams 16 in the region of the inlet opening 2. In so doing, the introduced razor blade unit 4 presses against the compression-type spring 31, which is disposed in the rearmost position, thereby pushing this spring 31, along with the razor blade unit 4 disposed ahead of it, one position toward the front. In this position, the catch means 20 of the arms 18 are already disengaged from the receiving holes 27 of the razor blade unit 4.

Due to the upward angling of the edges 33, the catch means 20 of the arms 18 of the end 8 subsequently glide upwardly, over the razor blade unit 4 disposed ahead of it, toward the front and the removal opening 3. The forwardmost razor blade unit 4 has already been raised at that location due to the thrust of the guide rails 35 disposed there. Together with the downward angling of the edges 33, the arms 18 of the end 8 engage the razor blade unit 4, whereby subsequently, after passing the two cams 16 as well as the funnel-like expansion, the arms 18 catch in the razor blade unit 4 when the arms 18 again move into their normal position due to the spring 19. Finally, the unused razor blade unit 4 can be removed from the dispenser housing 1.

This procedure can be repeated until all of the unused razor blade units 4 have been removed from the dispenser housing 1. In this connection, the cams 16 in the region of the inlet or introduction opening 2 are embodied in such a way that withdrawal of a used razor blade unit 4 toward the rear is prevented due to the fact that the rearmost razor blade unit 4 butts against these cams 16. When no unused razor blade units 4 are any longer present within the dispenser housing 1, the compression-type spring 31 reaches the forwardmost position, thereby butting against the cams 16 in the region of the removal opening 3 in such a way that the spring 31 cannot pass the cams 16. In so doing, the spring 31 has the function of a barrier or stop that prevents the forwardmost used razor blade units 4 from passing into the removal position and being mistakenly removed as an unused razor blade unit 4. This situation is illustrated in FIG. 15.

The present invention is, of course, in no way restricted to the specific disclosure of the specification and drawings, but also encompasses any modifications within the scope of the appended claims.

What I claim is:

1. In a dispenser system for razor blade units, several of which are successively arranged in a dispenser housing in such a way that they rest parallel against one another, with said razor blade units being adapted to be removed from, and possibly reinserted in, said dispenser housing via a handle to form a razor, and with an end of said handle, as well as said razor blade units, having latching mechanisms that cooperate with one another, the improvement wherein:

said razor blade units are disposed in said dispenser housing in such a way that they can be shifted in their entirety both perpendicular to their longitudinal dimensions as well as in a plane formed by them, with that moved-up razor blade unit that at any given time is in a forwardmost position being located, for removal thereof by said handle, in a removal position that is common for all of said razor blade units and is provided at a removal opening that is disposed at an end of said dispenser housing; and said dispenser housing has, for said end of said handle, a guide mechanism that ends in the vicinity of said removal opening and has a configuration that, as said handle end along with said latching mechanism thereof is guided along, brings said last-mentioned latching mechanism into a disengaged position, whereby, as said latching mechanism of said handle end reaches said removal position, said guide mechanism releases this latching mechanism so that the latter changes into a latching position, which forms a normal position, thereby latching with said razor blade unit that is to be removed.

2. A dispenser system according to claim 1, in which said dispenser housing has an upper side, with said guide mechanism being disposed on said upper side and parallel to the direction of shift of said razor blade units.

3. A dispenser system according to claim 2, which includes a compression-type spring disposed between the rearmost razor blade unit and an end wall of said dispenser housing disposed opposite said removal opening thereof.

4. A dispenser system according to claim 2, in which said handle is provided with a manually actuatable device for changing said latching mechanism of said handle into a disengaged position for release of a razor blade unit.

5. A dispenser system according to claim 2, in which said dispenser housing has an end wall opposite said removal opening that has an inlet opening for the reinsertion of used razor blade units, with said guide mechanism beginning in the vicinity of said inlet opening; upon insertion of a used razor blade unit, and during guidance of said handle end along said guide mechanism from said inlet opening to said removal opening, said configuration of said guide mechanism brings said latching mechanism of said handle end into the disengaged position, thereby releasing the connection thereof to said reinserted razor blade unit.

6. A dispenser system according to claim 5, in which said latching mechanism of said handle end comprises two arms, each having a first end that is pivotably mounted in said handle end in such a way that said arms are pivotable in opposite directions against the force of a spring, with each of said arms also having a second front end that is provided with catch means that is directed counter to the direction of pivot of its arm; in which said latching mechanism of said razor blade units comprises receiving holes that cooperate with said catch means; and in which said guide mechanism includes two spaced-apart, parallel C-shaped guide channels for accommodating said catch means, with the distance between said guide channels being such that said arms are pivoted into the disengaged position, and with said guide channels, in the vicinity of said inlet and removal openings, being directed at an angle into said engaged and disengaged positions respectively.

7. A dispenser system according to claim 6, in which said arms are pivotable inwardly toward one another, and said catch means are directed outwardly away from one another.

8. A dispenser system according to claim 6, in which, in the vicinity of said inlet and removal openings, said dispenser housing is provided with guides for said latching mechanism of said handle end, with said guides extending at an angle relative to the direction of shift of said razor blade units.

9. A dispenser system according to claim 2, in which said dispenser housing is in the form of an essentially flat, hollow parallelepiped having oppositely disposed open end faces, one of which defines said removal opening for unused razor blade units, and the other of which defines an inlet opening for the reinsertion of used razor blade units; in which said upper side of said dispenser housing is provided with a further opening, which is defined by edges of said dispenser housing and extends from said inlet opening to said removal opening, with said further opening having ends, in the vicinity of said inlet and removal openings, that are widened in a trapezoidal shape, and with said dispenser housing edges that define said further opening extending parallel to one another in a central region thereof to define first rails; in which said latching mechanism of said handle end comprises two arms, each having a first end that is pivotably mounted in said handle end in such a way that said arms are pivotable inwardly toward one another against the force of a spring, with each of said arms also having a second front end that is provided with catch means, whereby said catch means are directed outwardly away from one another; in which said latching mechanism of said razor blade units comprises receiving holes that cooperate with said catch means; and in which said arms are each provided with an outer edge having a recessed guide portion that cooperates with the corresponding one of said first rails of said dispenser housing.

10. A dispenser system according to claim 9, which includes a receiving channel within said dispenser housing for said razor blade units, and in which in said central region of said further opening relative to the insertion and removal planes of said razor blade units into and out of said inlet and removal openings respectively, said upper side of said dispenser housing, together with said first rails thereof, are offset upwardly, and/or said receiving channel is offset downwardly, in such a way that said catch means of said arms of said latching mechanism of said handle end, after release of a reinserted user razor blade unit, are movable from this rear position to the forward removal position over the razor blade units disposed between these positions.

11. A dispenser system according to claim 9, in which said dispenser housing has side walls that are provided with second guide rails for laterally guiding said razor blade units within said dispenser housing.

12. A dispenser system according to claim 9, in which said dispenser housing is comprised of two halves and is divided along a central longitudinal axis.

13. A dispenser system according to claim 9, in which said dispenser housing is provided on the outside with transversely extending reinforcement ribs.

14. A dispenser system according to claim 2, in which said dispenser housing is provided with an inlet opening, for used razor blade units, at an end thereof opposite said removal opening, with spring-like cams being provided in said dispenser housing, in the vicinity of said inlet and removal openings, for holding said razor blade units within said dispenser housing, whereby, however, a razor blade unit that is to be removed or reinserted can pass said cams after overcoming the holding force exerted thereby.

15. A dispenser system according to claim 2, in which each of said razor blade units is provided with a central rib, and said end of said handle is provided with a projecting pronged member that is spring-loaded in a direction toward said handle end, cooperates with said central rib, and receives the same.

16. A dispenser system according to claim 2, in which said guide mechanism is provided with guide strips that cooperate with said end of said handle.

17. A dispenser system according to claim 14, which includes a compression-type spring that is disposed in said dispenser housing between a last unused razor blade unit and a first used razor blade unit.

18. A dispenser system according to claim 17, in which said compression-type spring has a configuration such that said spring is unable to pass said spring-like cams in the vicinity of said removal opening.

* * * * *

Adverse Decisions in Interference

Patent No. 4,978,031, Max Lembke, DISPENSER SYSTEM FOR RAZOR BLADE, Interference No. 103,362, final judgment adverse to the patentee rendered October 22, 1997, as to claims 1-18. *(Official Gazette April 21, 1998)*